US010527271B2

(12) United States Patent
Koo et al.

(10) Patent No.: US 10,527,271 B2
(45) Date of Patent: Jan. 7, 2020

(54) LED LIGHTING DEVICE

(71) Applicant: Samsung Electronics Co., Ltd., Suwon-si (KR)

(72) Inventors: Won Hoe Koo, Suwon-si (KR); Il Seok Lee, Seoul (KR); Dong Hyuk Kim, Seoul (KR)

(73) Assignee: SAMSUNG ELECTRONICS CO., LTD., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 172 days.

(21) Appl. No.: 15/652,043

(22) Filed: Jul. 17, 2017

(65) Prior Publication Data

US 2018/0231226 A1 Aug. 16, 2018

(30) Foreign Application Priority Data

Feb. 10, 2017 (KR) ..... 10-2017-0018589

(51) Int. Cl.

| | |
|---|---|
| ***F21V 23/04*** | (2006.01) |
| ***H05B 33/08*** | (2006.01) |
| ***F21Y 115/10*** | (2016.01) |
| ***F21Y 113/13*** | (2016.01) |

(52) U.S. Cl.

CPC ..... *F21V 23/04* (2013.01); *H05B 33/0827* (2013.01); *F21Y 2113/13* (2016.08); *F21Y 2115/10* (2016.08)

(58) Field of Classification Search

CPC . F21V 23/04; H05B 33/0827; H05B 33/0857; F21Y 2113/13; F21Y 2115/10

See application file for complete search history.

(56) References Cited

U.S. PATENT DOCUMENTS

| | | | | |
|---|---|---|---|---|
| 9,072,149 | B2 | 6/2015 | Wu et al. | |
| 9,253,849 | B2 | 2/2016 | Ter Weeme et al. | |
| 2008/0252197 | A1* | 10/2008 | Li | H05B 33/0818 313/502 |
| 2010/0066258 | A1* | 3/2010 | Yasuda | H05B 33/0803 315/186 |
| 2011/0089864 | A1* | 4/2011 | Wasniewski | H05B 33/0818 315/295 |

(Continued)

FOREIGN PATENT DOCUMENTS

| | | |
|---|---|---|
| JP | 5932497 | 12/2013 |
| JP | 2014038789 | 2/2014 |

(Continued)

*Primary Examiner* — Mary Ellen Bowman

(74) *Attorney, Agent, or Firm* — Muir Patent Law, PLLC

(57) ABSTRACT

An LED lighting device is provided. The LED lighting device may include a light source configured to emit a light of first color temperature, second color temperature, and third color temperature and a switch electrically connected to the light source to control the light source to emit the lights of the first color temperature, the second color temperature, and the third color temperature, respectively. The light source includes a first light source configured to emit a light of a first color temperature, and a second light source configured to emit a light of a second color temperature that is different from the first color temperature, and the light source emits a light of a third color temperature between the first and second color temperatures when the switch parallel-connects the first light source and the second light source.

20 Claims, 12 Drawing Sheets

(56) References Cited

U.S. PATENT DOCUMENTS

| | | | | |
|---|---|---|---|---|
| 2014/0197751 | A1* | 7/2014 | Grajcar | H05B 33/0809 315/192 |
| 2014/0210357 | A1* | 7/2014 | Yan | H05B 33/0824 315/186 |
| 2015/0008848 | A1 | 1/2015 | Chen et al. | |
| 2016/0249431 | A1 | 8/2016 | Yan et al. | |
| 2016/0255683 | A1 | 9/2016 | Wu et al. | |
| 2017/0223800 | A1* | 8/2017 | Wu | H05B 33/083 |

FOREIGN PATENT DOCUMENTS

| | | |
|---|---|---|
| JP | 2016154154 | 8/2016 |
| KR | 20130034873 | 4/2013 |

* cited by examiner

LED LIGHTING DEVICE

CROSS-REFERENCE TO RELATED APPLICATION

This application claims priority from Korean Patent Application No. 10-2017-0018589 filed on Feb. 10, 2017 in the Korean Intellectual Property Office, and all the benefits accruing therefrom under 35 U.S.C. 119, the contents of which in its entirety are herein incorporated by reference.

BACKGROUND

1. Technical Field

The present disclosure relates to a light emitting diode (LED) lighting device.

2. Description of the Related Art

A light-emitting device such as an LED emits light by combination of electrons and holes. Such light-emitting device has characteristics that it needs less power consumption, has a long service life, is installable even in narrow spaces, and has a strong durability against vibration.

The light-emitting device emits light of certain wavelength. A white light-emitting device includes a phosphor on the light-emitting device that emits a certain wavelength light, and converts the wavelength of a portion of the light emitted from the light-emitting device into another wavelength and combines the converted light with another light of non-converted wavelength to thus generate white light.

The correlated color temperature (CCT) of the LED lighting may be adjusted with channels having desired color temperatures, i.e., CCT may be adjusted according to which channel is turned on and which channel is turned off.

Such variation of the color temperature involves adjustment of current values by using deeming per channel of a power supply (PSU), or use of automation configuration by connecting a highly expensive device such as Bluetooth, and so on. Accordingly, such related structure may relatively be costly.

SUMMARY

Example embodiments of the present disclosure provide an LED lighting device in which the color temperature may be adjusted at low cost.

The objects according to the present disclosure are not limited to those set forth above and objects other than those set forth above will be clearly understood to a person skilled in the art from the following description.

According to an aspect of the present inventive concept, there is provided an LED lighting device which may include: a first light source module configured to emit a light of a first color temperature; a second light source module configured to emit a light of a second color temperature that is different from the first color temperature; and a switch module configured to control an on state and an off state of the first light source module and an on state and an off state of the second light source module, wherein an operation mode of the switch module comprises: a first mode of operation in which the first light source module is turned on and the second light source module is turned off such that the first light source module emits the light of the first color temperature; a second mode of operation in which the second light source module is turned on and the first light source module is turned off such that the second light source module emits the light of the second color temperature; and a third mode of operation in which the first and second light source modules are simultaneously turned on such that the first and second light source modules emit a light of a third color temperature that is between the first color temperature and the second color temperature.

According to another aspect of the present inventive concept, there is provided an LED lighting device which may include: a power supply configured to supply a constant current; a first channel in which one or more first type of LEDs are disposed in series, wherein a light of each of the first type of LEDs has a first color temperature; a second channel in which one or more second type of LEDs are disposed in series, wherein a light of each of the second type of LEDs has a second color temperature different from the first color temperature; and a switch configured to turn on the one or more first type of LEDs and the one or more second type of LEDs in at least three operation modes comprising: a first operation mode of electrically connecting the first channel to the power supply; a second operation mode of electrically connecting the second channel to the power supply; and a third operation mode of parallel-connecting the first channel and the second channel and electrically connecting the power supply to both of the first channel and the second channel.

According to still another aspect of the present inventive concept, there is provided an LED lighting device which may include a light source configured to emit a light of first color temperature, second color temperature, and third color temperature and a switch electrically connected to the light source to control the light source to emit the lights of the first color temperature, the second color temperature, and the third color temperature, respectively. The light source may include a first light source configured to emit a light of a first color temperature, and a second light source configured to emit a light of a second color temperature that is different from the first color temperature, and the light source emits a light of a third color temperature between the first and second color temperatures when the switch parallel-connects the first light source and the second light source.

According to still another aspect of the present inventive concept, there is provided a method of operating an LED lighting device which may include: providing a first light source configured to emit a light of a first color temperature; providing a second light source configured to emit a light of a second color temperature that is different from the first color temperature; connecting, in a first mode of operation, the first light source to a switch to receive a constant current from a power supply for turning on the first light source to emit light of the first color temperature; connecting, in a second mode of operation, the second light source to the switch to receive the constant current from the power supply for turning on the second light source to emit the light of the second color temperature; and connecting, in a third mode of operation, the first light source and the second light source to the switch for simultaneously turning on both the first light source and the second light source to emit a light of a third color temperature that is between the first color temperature and the second color temperature.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
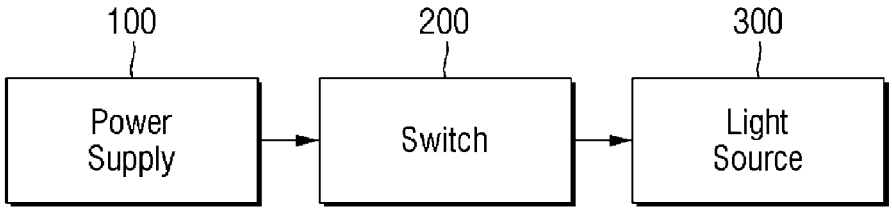
FIG. 1 is a block diagram provided to explain an LED lighting device according to some exemplary embodiments.

The present disclosure now will be described more fully hereinafter with reference to the accompanying drawings, in which various embodiments are shown. The invention may, however, be embodied in many different forms and should not be construed as limited to the example embodiments set forth herein. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

It will be understood that, although the terms first, second, third etc. may be used herein to describe various elements, components, regions, layers and/or sections, these elements, components, regions, layers and/or sections should not be limited by these terms. Unless the context indicates otherwise, these terms are only used to distinguish one element, component, region, layer or section from another element, component, region, layer or section, for example as a naming convention. Thus, a first element, component, region, layer or section discussed below in one section of the specification could be termed a second element, component, region, layer or section in another section of the specification or in the claims without departing from the teachings of the present invention. In addition, in certain cases, even if a term is not described using "first," "second," etc., in the specification, it may still be referred to as "first" or "second" in a claim in order to distinguish different claimed elements from each other.

As is traditional in the field of the inventive concepts, embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope of the inventive concepts. Further, the blocks, units and/or modules of the embodiments may be physically combined into more complex blocks, units and/or modules without departing from the scope of the inventive concepts.

In the following description, an LED lighting device according to some exemplary embodiments will be explained with reference to FIGS. 1 and 2.

FIG. 1 is a block diagram provided to explain an LED lighting device according to some exemplary embodiments.

Referring to FIG. 1, the LED lighting device according to some exemplary embodiments includes a power supply 100, a switch module 200, and a light source module 300 which has at least one LED device disposed thereon and is electrically connected to the power supply 100 via the switch module 200. The power supply 100 according to some exemplary embodiments can include circuit components on a printed circuit board. For example, the power supply 100 may include circuit components configured to generate or convert power and supply the power to the switch module 200.

The power supply 100 may supply power to the switch module 200. The power supply 100 may supply the power to the light source module 300 via the switch module 200. The switch module 200 may provide a constant current. For example, the power supply 100 may not be provided with a function of adjusting a color temperature and so on of the light source module 300 by adjusting current values. Instead, the power supply 100 may be configured to provide a constant current, and thus can be more economic compared to a power supply that includes more functions. For example, a constant current may refer to a DC or AC current whose constant value or whose periodic peak values do not change. Accordingly, compared to a power supply that can vary a current value, the power supply 100 may not have a selectable range of current values from which to supply to the switch module 200 and light source module 300, and may secure relatively better durability.

The switch module 200 may be electrically connected to the power supply 100. The switch module 200 may be electrically connected to the light source module 300. For example, the switch module 200 may electrically connect the power supply 100 and the light source module 300. In an example, the switch module 200 may electrically connect some of the respective light sources of the light source module 300 selectively to the power supply 100. For example, according to some embodiments, the switch module 200 may include one or more switches, e.g., a metal-oxide-semiconductor field-effect transistor (MOSFET) configured to be turned on upon receiving current from the power supply 100. Each switch of the switch module 200 may include a first terminal coupled to the power supply 100 and a second terminal coupled to the light source 300. The configuration in which the switch module 200 and the light source module 300 are connected to each other will be specifically explained below.

The light source module 300 may be electrically connected to the switch module 200. The light source module 300 may be electrically connected to the power supply 100 via the switch module 200. The light source module 300 may emit light. The light source module 300 may include therein at least one light source having one or more LED devices. In the light source module 300, at least a portion of one of the light sources may be selectively connected to the power supply 100 by the switch module 200.

Figure 2:
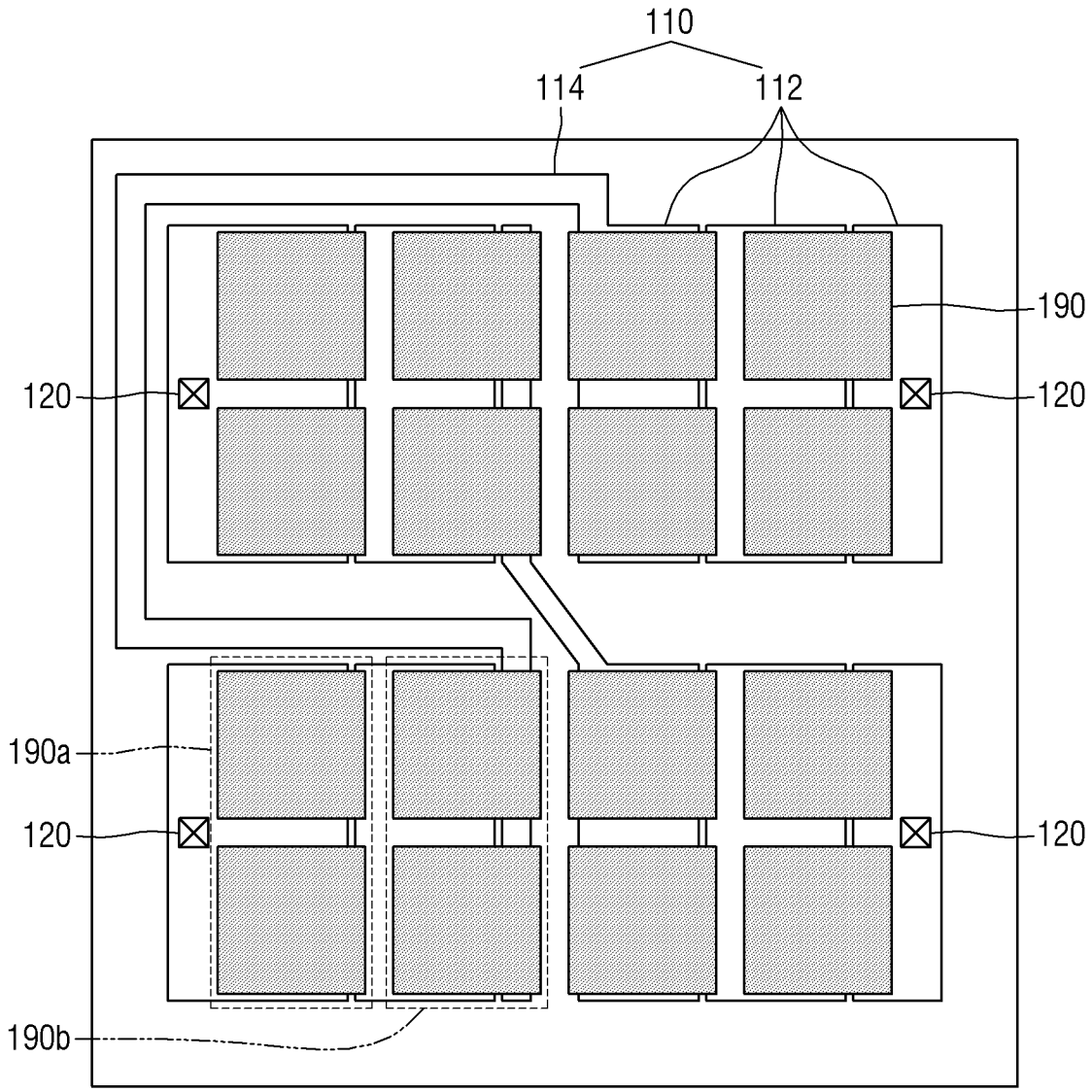
FIG. 2 is an exemplary top view provided to explain arrangement form of the light source module in FIG. 1.

FIG. 2 is an exemplary top view provided to explain arrangement form of the light source module 300 in FIG. 1.

Referring to FIG. 2, in the LED lighting device according to some exemplary embodiments, a plurality of LED devices 190 mounted on one mount part 112 are connected in series with each other and a plurality of LED devices 190 are connected in parallel with each other. Unlike the illustration, in some embodiments, a plurality of LED devices 190 mounted on one mount part 112 may be connected only in series with each other. Further, although FIG. 2 illustrates that a certain number of LED devices 190 are mounted on one mount part 112 in series and in parallel, a greater number of LED devices 190 may be mounted.

A plurality of LED devices 190 mounted on the one mount part 112 may form an LED device group. In FIG. 2, a light-emitting device group includes four LED devices 190, although the scope of the present disclosure is not limited hereto. For example, in some embodiments, a light-emitting device group may include less than four LED devices 190, and in some embodiments, a light-emitting device group may include more than four LED devices 190. Because the mount part 112, according to this exemplary embodiment, includes pads connected in series only, sets of LED devices 190 in a light-emitting device group may be connected in series only. Further, as shown in this exemplary embodiment, a plurality of light-emitting devices 190 in a set of LED devices 190 of a light-emitting device group may be connected in parallel (e.g., the first set 190*a* of LED devices 190 includes two LED devices 190 connected in parallel with respect to each other, and the second set 190*b* of LED devices 190 includes two LED devices 190 connected in parallel with respect to each other, and the first set 190*a* of LED devices 190 is connected in series with the second set 190*b* of LED devices 190.

A group of a plurality of LED devices, or sets of LED devices connected only in series may be defined as one light source module. For example, a plurality of LED devices 190 or sets of LED devices 190 grouped in series as one may become one light source module. There may be a plurality of such light source modules. As shown in the various figures, a light source module may refer to a set of LEDs connected in a manner such that the module has an anode where anodes of one or more first LEDs of the light source module receive power from a power supply and a cathode where cathodes of one or more last LEDs of the light source module output a current that has passed through the LEDs of the light source module.

In the following description, the operation mode of the LED lighting device according to some exemplary embodiments will be described with reference to FIGS. 3 to 5.

Figure 3:
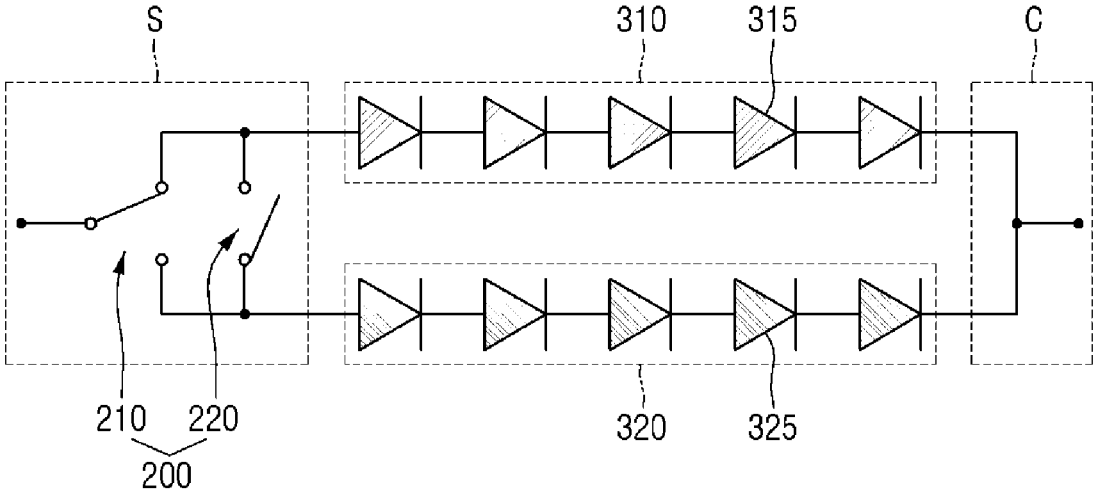
FIG. 3 is an equivalent circuit diagram provided to explain first mode of an LED lighting device according to some exemplary embodiments.
Figure 4:
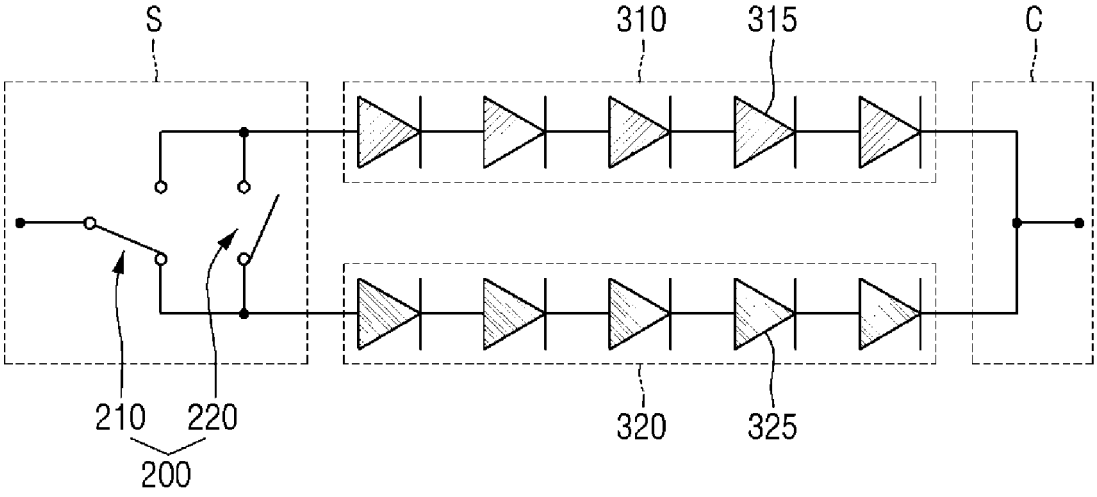
FIG. 4 is an equivalent circuit diagram provided to explain second mode of an LED lighting device according to some exemplary embodiments.

FIG. 3 is an equivalent circuit diagram provided to explain first mode of an LED lighting device according to some exemplary embodiments, and FIG. 4 is an equivalent circuit diagram provided to explain second mode of an LED lighting device according to some exemplary embodiments. FIG. 5 is an equivalent circuit diagram provided to explain third mode of an LED lighting device according to some exemplary embodiments.

Figure 5:
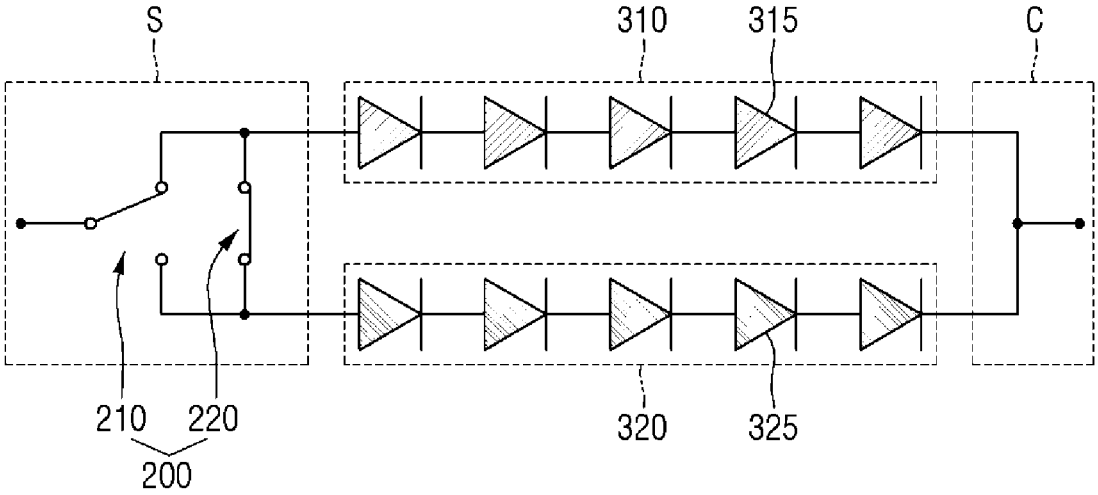
FIG. 5 is an equivalent circuit diagram provided to explain third mode of an LED lighting device according to some exemplary embodiments.

Referring to FIGS. 3 to 5, the LED lighting device according to some exemplary embodiments may include a switch unit S, a common terminal C, a first light source module 310, and a second light source module 320.

The switch unit S may be an area where the switch module 200 is formed. The switch unit S may be electrically connected to the first light source module 310 and the second light source module 320. Specifically, the switch unit S may be formed on one end portion of first and second channels where the first light source module 310 and the second light source module 320 are positioned. For example, the switch unit S may be a portion that determines where the first and second channels are connected. For example, the switch module 200 formed in the switch unit S may be configured to control an "on" state and an "off" state of each of the first light source module 310 and the second light source module 320. In an alternative embodiment, a separate controller (not shown) may be utilized to control an "on" state and an "off" state of each of the first light source module 310 and the second light source module 320.

The switch unit S may be connected to the power supply 100 of FIG. 1 to supply power to the first light source module 310 and/or the second light source module 320. As described above, because the power supply 100 of FIG. 1 provides a constant current value, the switch unit S may be used as a path of transmitting corresponding current.

The first light source module 310 may be formed in the first channel, and the second light source module 320 may be formed in the second channel. The first channel and the second channel may be distinguished according to presence or absence of a terminal formed in the switch unit S. For example, because there are two terminals formed in the switch unit S, i.e., a terminal connected to the first light source module 310 and a terminal connected to the second light source module 320, the LED lighting device according to some exemplary embodiments may be regarded as including two channels.

The switch unit S may be a portion that connects the two channels to the power supply 100 of FIG. 1. Specifically, the switch module 200 positioned in the switch unit S may include a first switch 210 and a second switch 220.

The first switch 210 is configured to connect the power supply 100 of FIG. 1 to the first channel or the second channel. For example, the first switch 210 may connect the first or second channel to the power supply 100 of FIG. 1 exclusively. Accordingly, the first and second channels may be only selectively connected to the power supply 100 by the first switch 210. For example, in some embodiments, when the first switch 210 connects the first channel to the power supply 100 of FIG. 1, the second channel is not connected to the power supply 100 of FIG. 1. Alternatively, when the first switch 210 connects the second channel to the power supply 100 of FIG. 1, the first channel is not connected to the power supply 100 of FIG. 1.

The second switch 220 may connect the first channel and the second channel in parallel or may separate these channels from each other. For example, when the second switch 220 is closed, the first and second channels may be connected in parallel, and when the second switch 220 is open, the first and second channels may not be connected to each other in the switch unit S.

The switch module 200 may be a simple physical switch. For example, the switch module 200 may be at least one of a slide type switch and a rotary type switch. However, exemplary embodiments are not limited to the example given above. For example, the switch module 200 of the LED lighting device according to some exemplary embodiments is not limited to these specific examples only, and the switch module 200 may be another simple physical, or electrical switch that forms connection/disconnection.

The common terminal C may be a terminal where the first channel and the second channel are connected to each other. The common terminal C may be formed on the other end portion of the first channel and the second channel, i.e., an end portion positioned opposite the switch unit S. For example, because the first and second channels are already connected to each other in the common terminal C, it is possible to determine whether only the first channel is connected to the power supply 100, or whether only the second channel is connected to the power supply 100, or whether both the first channel and the second channel are simultaneously connected to the power supply 100, according to operation of the switch module 200 of the switch unit S.

Although not illustrated, the common terminal C may be connected to another portion of a circuit, in which case the LED lighting device according to some exemplary embodiments may form a closed circuit.

The first light source module 310 may be formed in the first channel. The first light source module 310 may have one or more first LEDs 315 connected in series. Although there are 5 first LEDs 315 illustrated in the drawing, exemplary embodiments are not limited hereto. For example, the number of the first LEDs 315 may be greater or less than 5.

The second light source module 320 may be formed in the second channel. The second light source module 320 may have one or more second LEDs 325 connected in series. Although there are 5 second LEDs 325 illustrated in the drawing, exemplary embodiments are not limited hereto. For example, the number of the second LED 325 may be greater or less than 5.

The number of the first LED 315 may be same as the number of the second LED 325. In the above example, similar light velocity may be kept even when any light source module is turned on. However, exemplary embodiments are not limited to the example given above. For example, in the LED lighting device according to some exemplary embodiments, because a light velocity of the first LED 315 may be different from a light velocity of the second LED 325, the number of the first LED 315 and the number of the second LED 325 may be different from each other.

The first LED 315 may have a higher color temperature than the second LED 325. For example, when the first LED 315 has a color temperature of 5,000 K, the second LED 325 may have a color temperature of 2,700 K. Thus, the first light source module 310 may have a higher color temperature than the second light source module 320. The first light source module 310 or the first LED 315 may be configured to provide "cool" lighting, and the second light source module 320 or the second LED 325 may be configured to provide "warm" lighting.

Generally, because the lighting device should have both of the "cool" lighting mode and the "warm" lighting mode, the structure may selectively drive each of the lighting devices. For example, the LED lighting device according to some exemplary embodiments may be operated according to a first mode of operation, which is the "cool" lighting mode of operation, a second mode of operation, which is the "warm" lighting mode of operation, and a third mode of operation in which the lighting device emits light having a color temperature between cool color temperature and warm color temperature.

Hereinbelow, the LED lighting device according to some exemplary embodiments will be described, in which modes change from each other as described above, according to operation of the switch module 200.

First, referring to FIG. 3, in the first mode of operation of the LED lighting device according to some exemplary embodiments, the first switch 210 may be connected to the first channel. Accordingly, the first switch 210 may not be connected to the second channel. Thus, the first light source module 310 may be electrically connected to the power supply 100. The first LEDs 315 in the first light source module 310 may emit light of a first color temperature with the power provided from the power supply 100. For example, the "cool" lighting may be turned on.

In this exemplary embodiment, the second switch 220 may be in an open state. Accordingly, the power of the power supply 100 may be provided only to the first channel, while the power of the power supply 100 is not provided to the second channel.

Second, referring to FIG. 4, in the second mode of operation of the LED lighting device according to some exemplary embodiments, the first switch 210 may be connected to the second channel. Accordingly, the first switch 210 may not be connected to the first channel. Thus, the second light source module 320 may be electrically connected to the power supply 100. The second LEDs 325 in the second light source module 320 may emit light of a second color temperature with the power provided from the power supply 100. For example, the "warm" lighting may be turned on.

In this exemplary embodiment, the second switch 220 may be in an open state. Accordingly, the power of the power supply 100 may be provided only to the second channel, while the power of the power supply 100 is not provided to the first channel.

Referring to FIG. 5, in the third mode of operation of the LED lighting device according to some exemplary embodiments, the first switch 210 may be connected to the first channel or the second channel. Although the drawing illustrates that the first switch 210 is connected to the first channel, exemplary embodiments are not limited thereto. Accordingly, the third mode can be operated successfully as long as the first switch 210 is connected to either of the first and second channels in the third mode. For example, the third mode may be operated successfully unless the first switch 210 is floated and thus disconnected from both of the first and second channels.

The second switch 220 may connect the first channel and the second channel to each other. When the second switch 220 is connected, the first channel and the second channel are connected to each other in parallel both at the common terminal C and the switch unit S.

Accordingly, both the first light source module 310 and the second light source module 320 may be connected to the power supply 100 of FIG. 1, to supply power. Because constant current is provided from the power supply 100, total currents supplied from the power supply 100 may be divided and supplied into the first and second channels according to a parallel connection.

The first LED 315*s* of the first light source module 310 and the second LED 325*s* of the second light source module 320 may be turned on simultaneously, in which case the overall lighting may be the mixture of the "cool" lighting and the "warm" lighting.

For example, when it is assumed that the first color temperature of the first LEDs 315 is 5,000 K and the second color temperature of the second LEDs 325 is 2,700 K, a color temperature of the lighting having the mixed colors in the third mode of operation of the lighting device may be about 3,500 K. For example, the lighting may be turned on at a color temperature between the first color temperature (during "cool" lighting) and the second color temperature (during "warm" lighting).

The LED lighting device according to some exemplary embodiments has simple configuration compared to conventional devices. For example, in one embodiment, an LED lighting device is configured with two channels respectively including the light source modules having different color temperatures from each other, and a simple physical switch. Thus, the lighting having a new color temperature from a mixture of different color temperatures can be provided without requiring an expensive equipment.

Since the first light source module 310 and the second light source module 320 are connected in parallel and the voltage applied is equal in each of these, there is no deviation among the first to third modes of the first light source module 310 and the second light source module 320, and stable lighting may be provided.

Further, without requiring complicated functions such as channel deeming or auto color temperature adjustment, the LED lighting device according to some exemplary embodiments may generate a lighting of a proper color temperature simply, stably, and at low cost. Accordingly, the LED lighting device can provide multi-color temperature lighting at low cost and with high efficiency.

Hereinbelow, an LED lighting device according to some exemplary embodiments will be described with reference to FIGS. 6 to 8. Elements or operations overlapping with the above explanation will be mentioned as briefly as possible or omitted for the sake of brevity.

Figure 6:
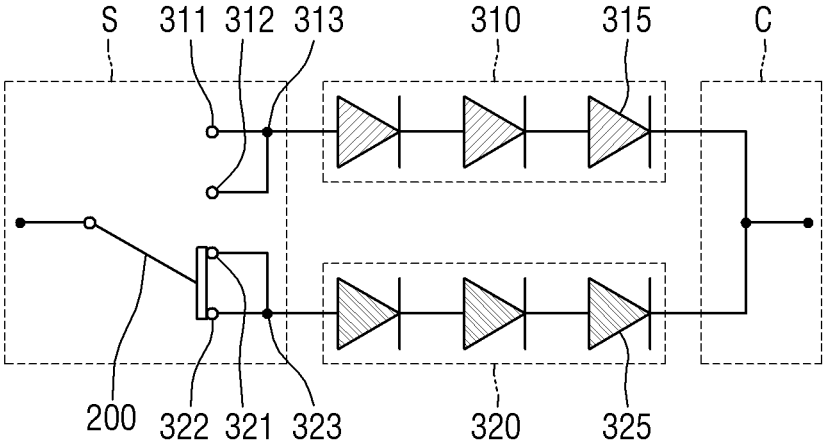
FIG. 6 is an equivalent circuit diagram provided to explain first mode of an LED lighting device according to some exemplary embodiments.
Figure 7:
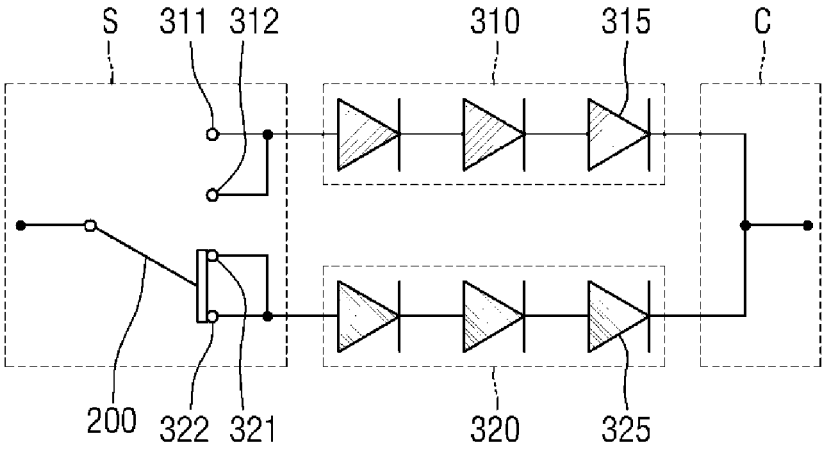
FIG. 7 is an equivalent circuit diagram provided to explain second mode of an LED lighting device according to some exemplary embodiments.

FIG. 6 is an equivalent circuit diagram provided to explain first mode of operation of an LED lighting device according to some exemplary embodiments, and FIG. 7 is an equivalent circuit diagram provided to explain second mode of operation of an LED lighting device according to some exemplary embodiments. FIG. 8 is an equivalent circuit diagram provided to explain a third mode of operation of an LED lighting device according to some exemplary embodiments.

Figure 8:
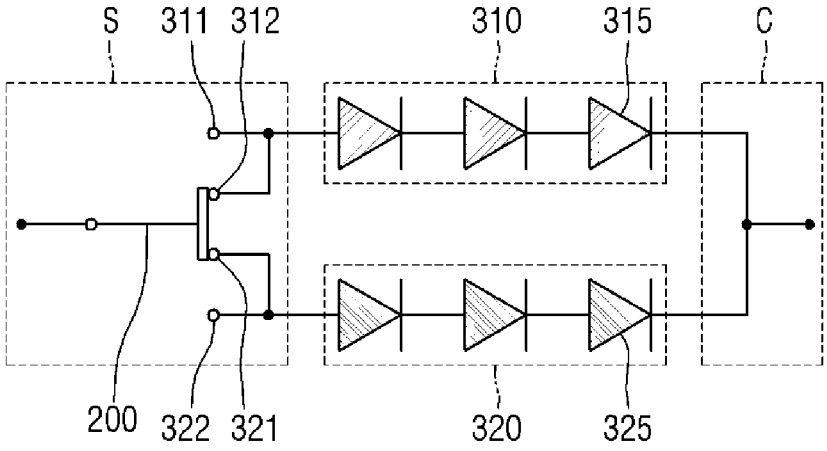
FIG. 8 is an equivalent circuit diagram provided to explain third mode of an LED lighting device according to some exemplary embodiments.

Referring to FIGS. 6 to 8, the LED lighting device according to some exemplary embodiments includes the switch unit S, the common terminal C, the first light source module 310, and the second light source module 320.

The configurations of the common terminal C, the first light source module 310, and the second light source module 320 as illustrated in FIGS. 6 to 8 are same as described above with respect to FIGS. 3 to 5. However, the configuration of the switch unit S may have certain differences. Further, although the drawing illustrates three first LEDs 315 and three second LEDs 325 respectively included in the first light source module 310 and the second light source module 320, this is merely one of exemplary embodiments and not limited hereto. For example, the number of the first LEDS 315 and the number of the second LEDS 325 of the LED lighting device according to some exemplary embodiments may be five as illustrated above, but, of course, a greater or less number of the LED may be possibly implemented.

The switch unit S may include one end portion of the first channel and the second channel, as in the exemplary embodiment described above. In an example, an end portion of the first channel including the first light source module 310 may include two terminals, i.e., a first terminal 311 and a second terminal 312. Likewise, an end portion of the second channel including the second light source module 320 may include two terminals, i.e., a third terminal 321 and a fourth terminal 322.

The first terminal 311 and the second terminal 312 may both be connected to the first channel, but may be branches that are branched off from one connected terminal (e.g., node 313). Likewise, the third terminal 321 and the fourth terminal 322 may both be connected to the second channel, but may be branches that are branched off from one connected terminal (e.g., node 323).

The first terminal 311, the second terminal 312, the third terminal 321, and the fourth terminal 322 may be spaced apart from each other by a constant interval, as illustrated in FIGS. 6 to 8. This is to allow the switch module 200 to connect only two adjacent terminals among the four terminals.

The switch module 200 may include a planar electrode (e.g., planar terminal) in a flat form. For example, as illustrated in FIGS. 6 to 8, the switch module 200 may be formed in a flat form so as to connect the two adjacent terminals among the first terminal 311, the second terminal 312, the third terminal 321, and the fourth terminal 322 at once.

A width of the planar terminal of the switch module 200 in a first direction may be greater than an interval of two adjacent terminals among the first terminal 311, the second terminal 312, the third terminal 321, and the fourth terminal 322 in the first direction. Thus, the two adjacent terminals among the first terminal 311, the second terminal 312, the third terminal 321 and the fourth terminal 322 may be simultaneously connected or coupled to the switch module 200 via the planar terminal. The width of the planar terminal of the switch module 200 in a first direction may be smaller than an interval of three adjacent terminals among the first terminal 311, the second terminal 312, the third terminal 321, and the fourth terminal 322 in the first direction.

First, referring to FIG. 6, the switch module 200 may be coupled to the first terminal 311 and the second terminal 312 simultaneously. Thus, the power supply 100 of FIG. 1 and the first light source module 310 of the first channel may be electrically connected to each other. Accordingly, the first light source module 310 may emit the light of a first color temperature. In this exemplary embodiment, when the switch module 200 is coupled to the first terminal 311 and the second terminal 312 simultaneously, the switch module 200 is not coupled to the third terminal 321 and the fourth terminal 322 of the second channel. Thus, the second light source module 320 of the second channel may not emit the light because the power supply 100 of FIG. 1 is not electrically connected to the second light source module 320, i.e., no power is provided to the second light source module 320. In this example, the first color temperature may be the relatively "cool" lighting such as 5,000 K. However, exemplary embodiments are not limited to the example given above.

Referring to FIG. 7, the switch module 200 may be simultaneously coupled to the third terminal 321 and the fourth terminal 322. Thus, the power supply 100 of FIG. 1 and the second light source module 320 of the second channel may be electrically connected to each other. Accordingly, the second light source module 320 may emit the light of a second color temperature. In this exemplary embodiment, when the switch module 200 is coupled to the third terminal 321 and the fourth terminal 322 simultaneously, the switch module 200 is not coupled to the first terminal 311 and the second terminal 312 of the first channel. Thus, the first light source module 310 of the first channel may not emit the light because the power supply 100 of FIG. 1 is not electrically connected to the first light source module 310, i.e., no power is provided to the first light source module 310. In this example, the second color temperature may be the relatively "warm" lighting such as 2,700 K. However, exemplary embodiments are not limited to the example given above.

Referring to FIG. 8, the switch module 200 may be simultaneously coupled to the second terminal 312 and the third terminal 321. Thus, the power supply 100 of FIG. 1, the first light source module 310 and the second light source module 320 of the first and second channels are simultaneously turned on, such that the light of a third color temperature at a medium stage between the first color temperature and the second color temperature may be emitted.

For example, when the first color temperature is 5,000 K and the second color temperature is 2,700 K, the third color temperature may be about 3,500 K. However, exemplary embodiments are not limited to the example given above.

In the LED lighting device according to some exemplary embodiments, the switch module 200 may be configured simply with one switch. Accordingly, the LED lighting device may provide a new color temperature from a mixture of different color temperatures without requiring an expensive equipment.

For example, in the LED lighting device according to some exemplary embodiments, the switch module 200 may simply use one switch to implement a high color temperature, a low color temperature, and a mixed color temperature thereof.

Hereinbelow, the LED lighting device according to some exemplary embodiments will be described with reference to FIG. 9. Elements or operations overlapping with the above explanation will be mentioned as briefly as possible or omitted for the sake of brevity.

Figure 9:
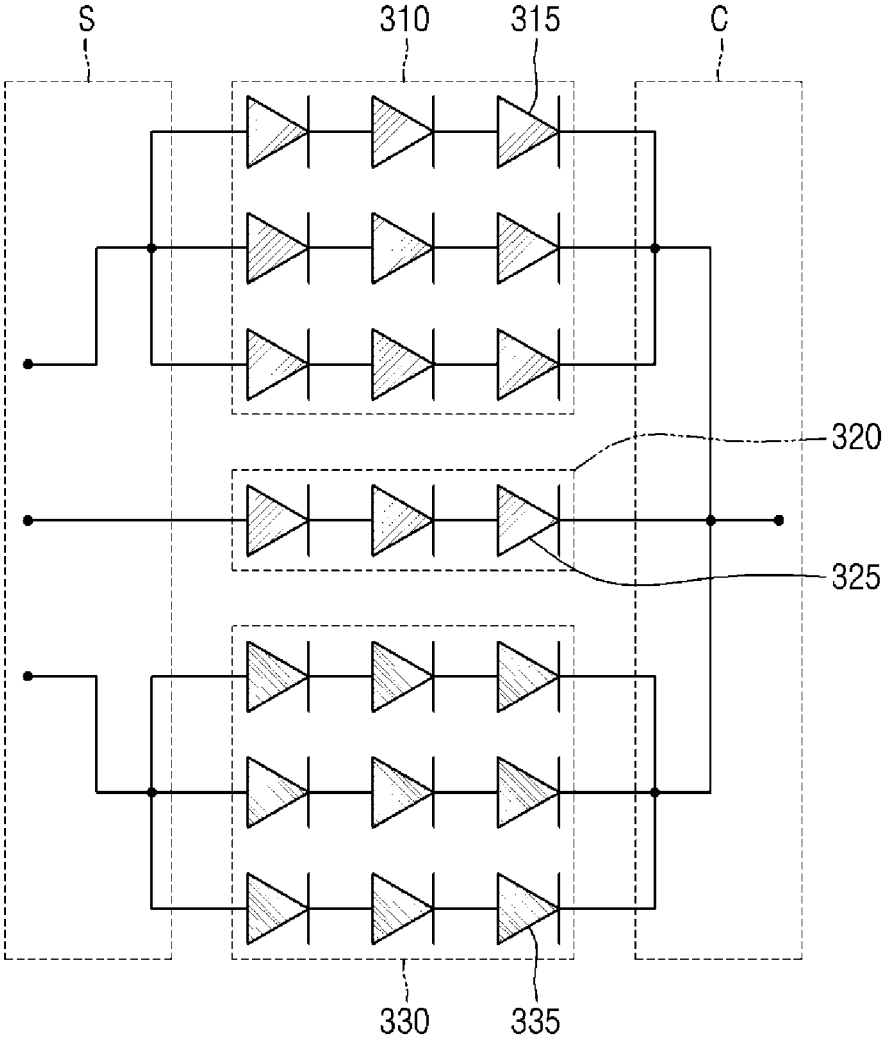
FIG. 9 is an equivalent circuit diagram provided to explain an LED lighting device according to some exemplary embodiments.

FIG. 9 is an equivalent circuit diagram provided to explain an LED lighting device according to some exemplary embodiments.

Referring to FIG. 9, the LED lighting device according to some exemplary embodiments may include three channels between the switch unit S and the common terminal C. The first light source module 310 may include at least one first LED 315 and the second light source module 320 may include at least one second LED 325. The third light source module 330 may include at least one third LED 335.

The first light source module 310 and the second light source module 320 may have different parallel numbers from each other. The term "parallel number" as used herein refers to a parameter representing the number of series-connected lines that are connected again in parallel.

For example, a parallel number of the first light source module 310 is 3 and a parallel number of the second light source module 320 is 1 in FIG. 9. Likewise, a parallel number of the third light source module 330 may be 3.

The first light source module 310 may be positioned in a first channel. The second light source module 320 may be positioned in a second channel. The third light source module 330 may be positioned in a third channel.

The first light source module 310 and the second light source module 320 may have a same color temperature as each other. For example, the first light source module 310 and the second light source module 320 may have a first color temperature. In an example, the first color temperature may be a relatively higher color temperature of the "cool" lighting. However, exemplary embodiments are not limited to the example given above.

The third light source module 330 may have a different color temperature from the first light source module 310 and the second light source module 320. For example, the third light source module 330 may have a second color temperature different from the first color temperature. In an example, the second color temperature may be a relatively lower color temperature of the "warm" lighting. However, exemplary embodiments are not limited to the example given above.

The LED lighting device according to some exemplary embodiments may include the first light source module 310 and the second light source module 320 having a same color temperature. However, the first light source module 310 and the second light source module 320 may have different parallel numbers from each other. For example, the parallel number for the first light source module 310 may be greater than the parallel number for the second light source module 320. However, the disclosure is not limited thereto. In some embodiments, the parallel number for the first light source module 310 may be less than the parallel number for the second light source module 320.

Thus, the LED lighting device according to some exemplary embodiments may not only simply obtaining a mixture of colors of two channels, but also adjust a color temperature of the light that is emitted to a desired color temperature.

Specifically, according to a ratio of the parallel numbers, a color temperature of the mixed light may be determined. For example, when the first light source module 310 and the third light source module 330 are turned on simultaneously, the parallel numbers are 3:3, i.e., 1:1. When the second light source module 320 and the third light source module 330 are turned on simultaneously, the parallel numbers are 1:3, and therefore, the medium color may be obtained as a result of mixture. Thus, compared to simultaneous turn-on of the first light source module 310 and the third light source module 330, light of a lower color temperature may be emitted.

The LED lighting device according to some exemplary embodiments may implement a desired color temperature by adding channels with various parallel numbers. The above example illustrates the mixing of the two colors; however, when the first light source module 310, the second light source module 320 and the third light source module 330 are all mixed, and the mixing will be performed at a ratio of 4:3 because the first light source module 310 and the second light source module 320 may have a same color temperature, and accordingly, another different color temperature may be achieved.

For example, the LED lighting device according to some exemplary embodiments may emit a desired color temperature more precisely according to addition of a channel, and implement various modes of emitting various color temperatures.

While it is exemplified above that LED lighting device according to some exemplary embodiments may have three channels, this is merely one of embodiments and not limited hereto. Further, while it is exemplified above that the parallel numbers of the first light source module 310, the second light source module 320 and the third light source module 330 are respectively 3, 1, 3, again, this may be merely one of embodiments, and exemplary embodiments may not be limited hereto.

In the following description, the LED lighting device according to some exemplary embodiments will be described with reference to FIG. 10. Elements or operations overlapping with the above explanation will be mentioned as briefly as possible or omitted for the sake of brevity.

Figure 10:
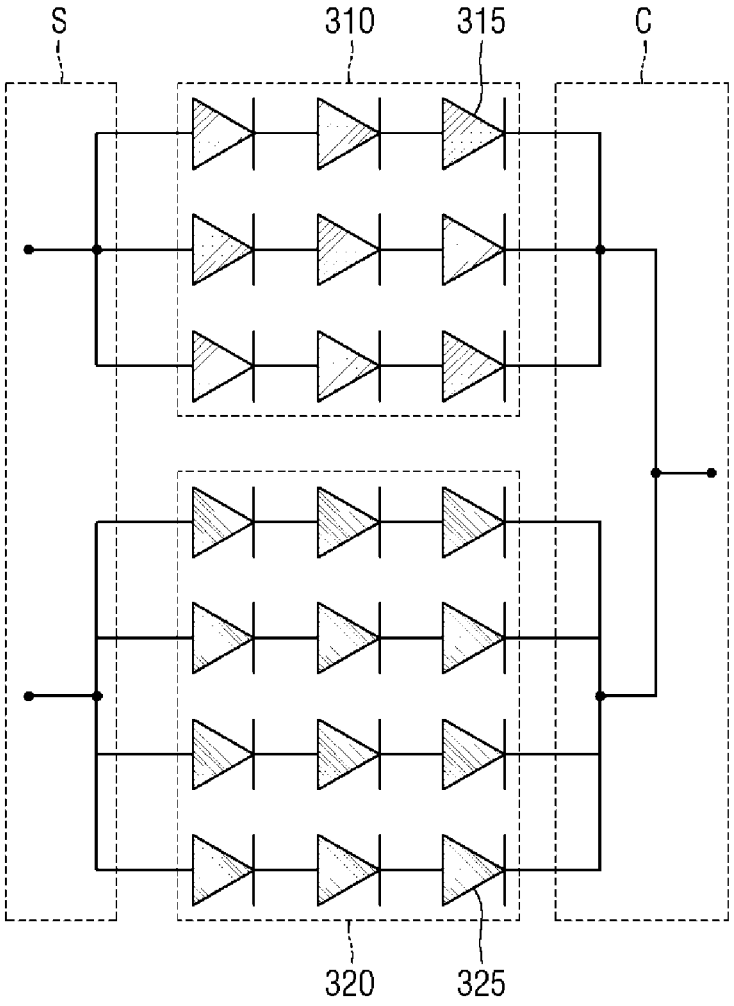
FIG. 10 is an equivalent circuit diagram provided to explain an LED lighting device according to some exemplary embodiments.

FIG. 10 is an equivalent circuit diagram provided to explain an LED lighting device according to some exemplary embodiments.

Referring to FIG. 10, the LED lighting device according to some exemplary embodiments may have two channels.

The first light source module 310 may include the first LED 315 having a first color temperature, and the second light source module 320 may include the second LED 325 having a second color temperature different from the first color temperature. Specifically, the first color temperature may be greater than the second color temperature. For example, the light of the first color temperature may be the "cool" lighting, and the light of the second color temperature may be the "warm" lighting. However, exemplary embodiments are not limited to the example given above.

In an example, a parallel number of the first light source module 310 may be smaller than a parallel number of the second light source module 320. The difference in the parallel numbers may be caused from deviations in a light velocity according to the color temperature. For example, because a light velocity of the cool LED is higher compared to the warm LED when the same number of warm light sources and cool light sources are connected, the light velocity and efficiency may increase when driving on the "cool" lighting mode compared to the "warm" lighting mode.

As illustrated in FIG. 10, when a parallel number of the "warm" lighting and a parallel number of the "cool" lighting are different, deviation in light velocity and efficiency between "warm"/"cool" lightings may be reduced. Accordingly, as deviations according to the mode recognized by a user of the lighting is reduced, sense of difference or fatigue may also be decreased. Further, as the deviations in light velocity in the optical equipment is reduced, fine errors in the process may be further reduced.

In the following description, the LED lighting device according to some exemplary embodiments will be described with reference to FIG. 11. Elements or operations overlapping with the above explanation will be mentioned as briefly as possible or omitted for the sake of brevity.

Figure 11:
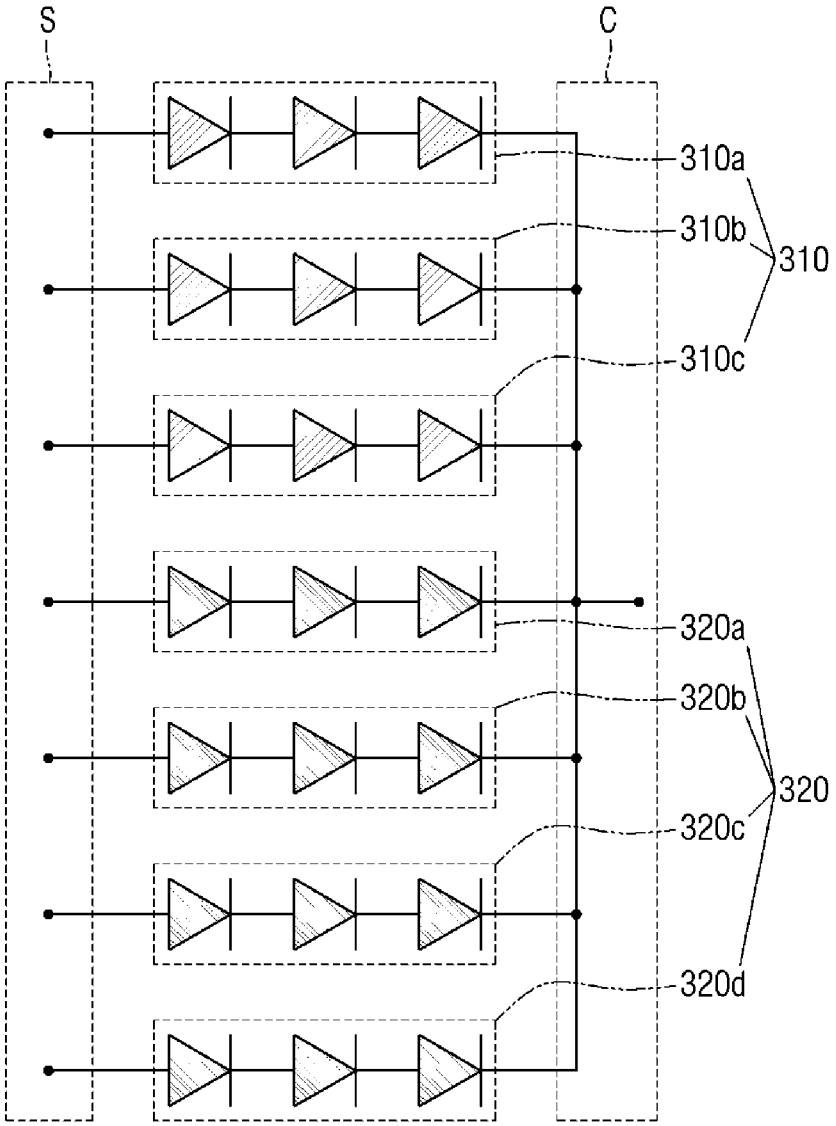
FIG. 11 is an equivalent circuit diagram provided to explain an LED lighting device according to some exemplary embodiments.

FIG. 11 is an equivalent circuit diagram provided to explain an LED lighting device according to some exemplary embodiments.

Referring to FIG. 11, the LED lighting device according to some exemplary embodiments may include the first light source module 310 and the second light source module 320, and each of the light source module may include a plurality of sub light source modules.

Specifically, the first light source module 310 may include one or more series-connected first LEDs 315, and the first LED 315 may emit light of a first color temperature. The second light source module 320 may include one or more series-connected second LEDs 325, and the second LED 325 may emit light of a second color temperature different from the first color temperature.

The first light source module 310 may include a first sub light source module 310*a*, a second sub light source module 310*b*, and a third sub light source module 310*c*. The second light source module 320 may include a fourth sub light source module 320*a*, a fifth sub light source module 320*b*, a sixth sub light source module 320*c*, and a seventh sub light source module 320*d*.

All of the sub light source modules may be formed in a unit channel having a parallel number of 1, respectively. The LED lighting device according to some exemplary embodiments may emit light of various color temperatures by freely combining a plurality of channels. Thus, a desired color temperature of the light may be easily provided. For example, a ratio of the parallel numbers of the first color temperature and the second color temperature may be freely adjusted from 1:1 to 3:4. For example, a ratio of the parallel numbers of the first color temperature and the second color temperature may be selected from the group consisting of 1:1, 1:2, 1:3, 1:4, 2:1, 2:2, 2:3, 2:4, 3:1, 3:2, 3:3, and 3:4.

In some embodiments, a method of operating an LED lighting device may include: providing a first light source configured to emit a light of a first color temperature; providing a second light source configured to emit a light of a second color temperature that is different from the first color temperature; connecting, in a first mode of operation, the first light source to a switch to receive a constant current from a power supply for turning on the first light source to emit light of the first color temperature; connecting, in a second mode of operation, the second light source to the switch to receive the constant current from the power supply for turning on the second light source to emit the light of the second color temperature; and connecting, in a third mode of operation, the first light source and the second light source to the switch for simultaneously turning on both the first light source and the second light source to emit a light of a third color temperature that is between the first color temperature and the second color temperature, wherein in the third mode of operation, the first light source and the second light source are connected to each other in parallel, in the first mode of operation, the second light source is not connected to the switch, and in the second mode of operation, the first light source is not connected to the switch.

In some embodiments, the method of operating the LED lighting device may further include: providing a third light source configured to emit the light of the first color temperature, wherein the first light source has a first parallel number, and the third light source has a second parallel number different from the first parallel number. In some embodiments, the method may further include: connecting, in a fourth mode of operation, the second light source and the third light source to the switch for simultaneously turning on the second light source and the third light source to emit a light of a fourth color temperature which is different from the first color temperature, the second color temperature, and the third color temperature. In the fourth mode of operation, the second light source and the third light source are parallel-connected to each other.

FIGS. 12 to 15 are views illustrating end products applied with an LED lighting device according to some exemplary embodiments.

Figure 12:
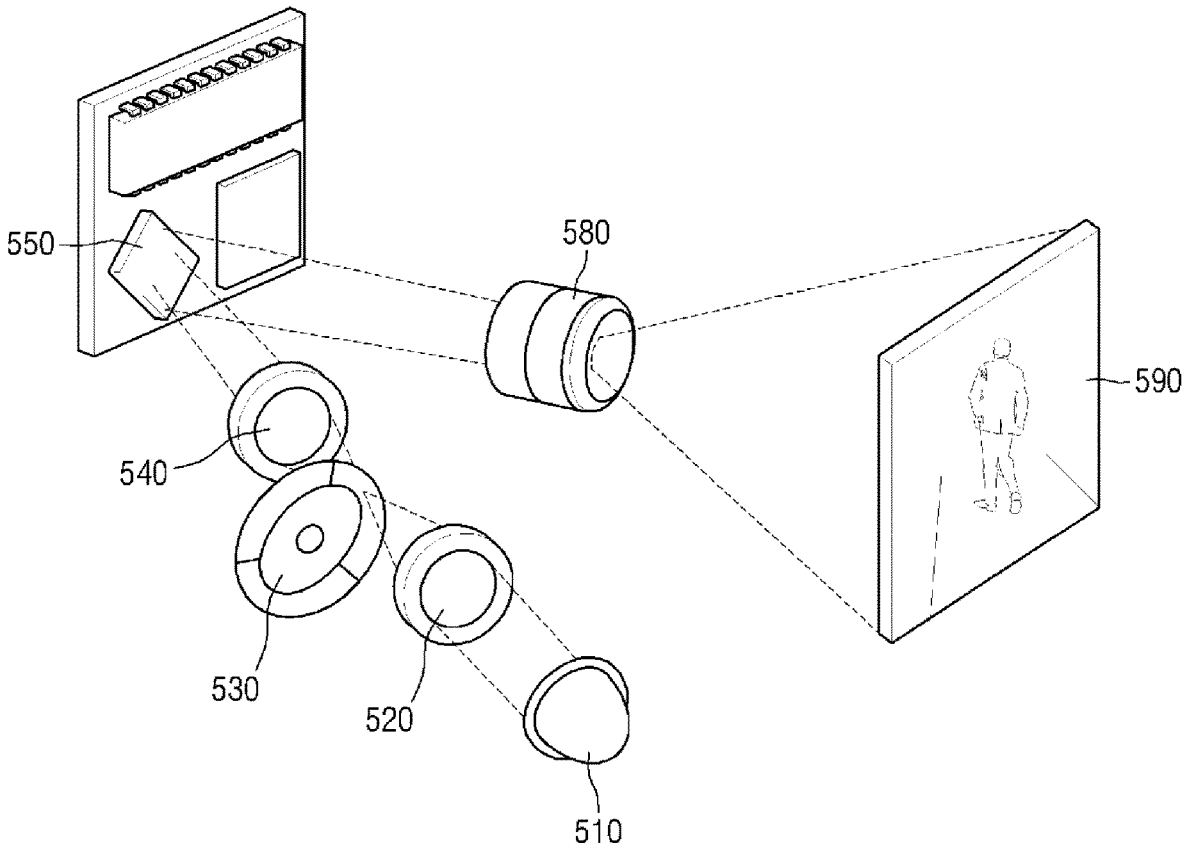
FIGS. 12 to 15 are views illustrating end products applied with an LED lighting device according to some exemplary embodiments.
Figure 13:
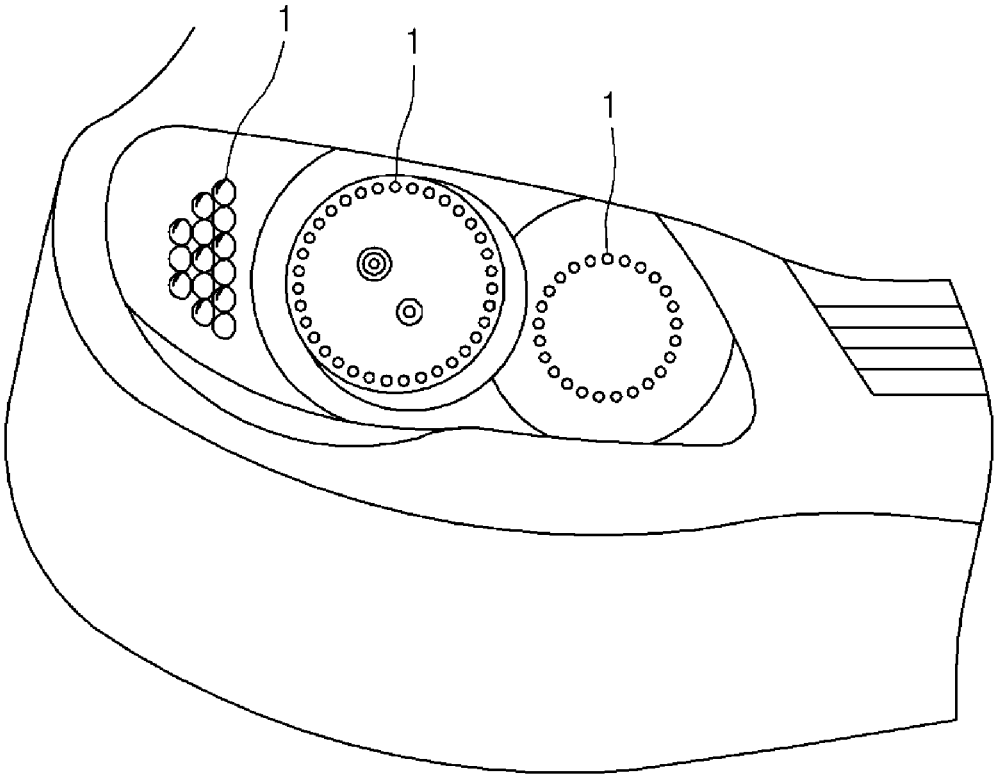
Figure 14:
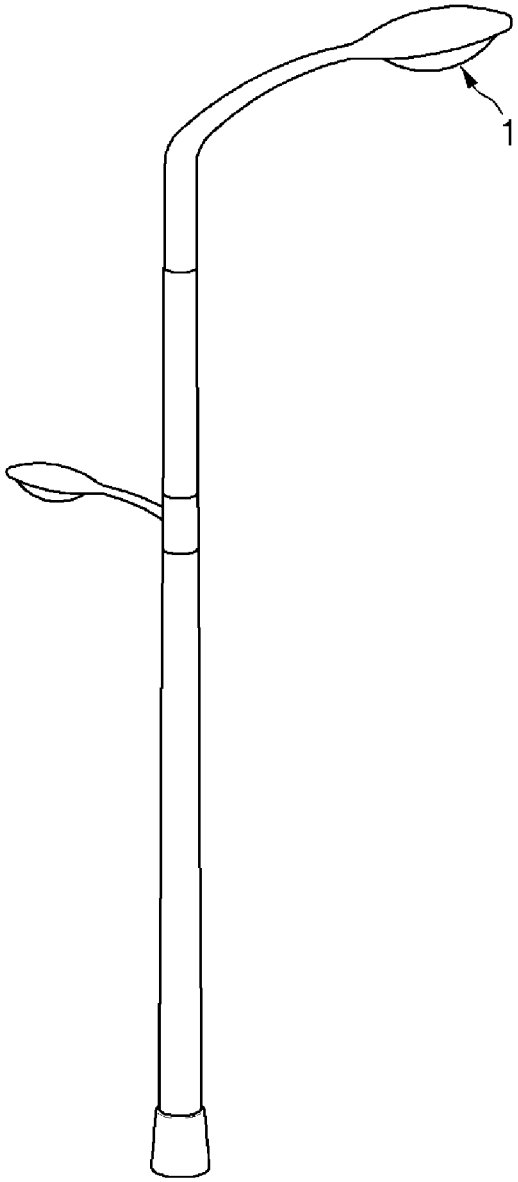
Figure 15:
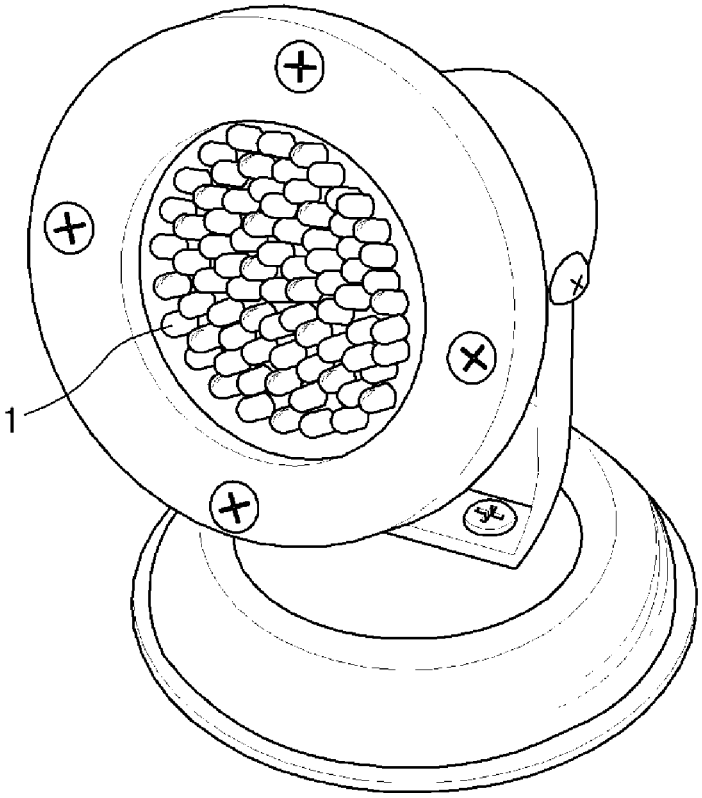

FIGS. 12 to 15 illustrate exemplary electronic devices (end products) applied with the LED lighting device described above. FIG. 12 illustrates a projector, FIG. 13 illustrates a headlight of a vehicle, FIG. 14 illustrates a streetlamp, and FIG. 15 illustrates a lighting lamp.

Referring to FIG. 12, the light emitted from the light source module 510 may pass through a condensing lens 520, a color filter 530, and a sharping lens 540, and then reflected from a digital micro mirror device 550 (DMD) to pass through a projection lens 580 and reach a screen 590. In the light source 510, the LED lighting device of the present disclosure may be mounted to allow a light of desired color temperature to be emitted.

Referring to FIG. 13, a headlight of a vehicle may include the LED lighting device of the present disclosure which may include a plurality of light sources 1. For example, a portion of the light sources 1 may form the first LEDs of the present disclosure having a first color temperature, and another portion of the light sources 1 may form the second LEDs of the present disclosure having a second color temperature different from the first color temperature.

Referring to FIG. 14, a streetlamp may include the LED lighting device of the present disclosure to allow a light of desired color temperature to be emitted.

Referring to FIG. 15, a lighting lamp may include the LED lighting device of the present disclosure which may include a plurality of light sources 1. In one embodiment, a portion of the light sources 1 may form the first LEDs of the present disclosure having a first color temperature, and another portion of the light sources 1 may form the second LEDs of the present disclosure having a second color temperature different from the first color temperature.

In concluding the detailed description, those skilled in the art will appreciate that many variations and modifications can be made to the exemplary embodiments without substantially departing from the principles of the present disclosure. Therefore, the disclosed exemplary embodiments of the inventive concept are used in a generic and descriptive sense only and not for purposes of limitation.

What is claimed is:

1. An LED lighting device, comprising:

a first light source module configured to emit a light of a first color temperature;

a second light source module configured to emit a light of a second color temperature that is different from the first color temperature; and a switch module configured to electrically connect a power supply to at least one of the first light source module and the second light source module and control an on state and an off state of the first light source module and an on state and an off state of the second light source module, wherein an operation mode of the switch module comprises:

a first mode of operation in which the first light source module is turned on and the second light source module is turned off such that the first light source module emits the light of the first color temperature;

a second mode of operation in which the second light source module is turned on and the first light source module is turned off such that the second light source module emits the light of the second color temperature; and a third mode of operation in which the first and second light source modules are simultaneously turned on such that the first and second light source modules emit a light of a third color temperature that is between the first color temperature and the second color temperature, and in the third mode of operation, the first light source module and the second light source module are connected to each other in parallel.

2. The LED lighting device of claim 1, wherein the power supply is connected to the switch module to supply power, and wherein the first light source module is positioned in a first channel, the second light source module is positioned in a second channel different from the first channel, and the switch module connects the power supply to the first channel in the first mode of operation, and connects the power supply to the second channel in the second mode of operation.

3. The LED lighting device of claim 2, wherein the switch module comprises:

a first switch configured to connect the first channel to the power supply in the first mode of operation and to connect the second channel to the power supply in the second mode of operation; and a second switch configured to parallel-connect the first channel and the second channel in the third mode of operation.

4. The LED lighting device of claim 3, wherein the second switch is open in the first mode of operation and the second mode of operation.

5. The LED lighting device of claim 2, further comprising:

a first terminal and a second terminal both connected to the first channel; and a third terminal and a fourth terminal both connected to the second channel, wherein the switch module connects the first terminal and the second terminal to the power supply in the first mode of operation, connects the second terminal and the third terminal to the power supply in the second mode of operation, and connects the third terminal and the fourth terminal to the power supply in the third mode of operation.

6. The LED lighting device of claim 5, wherein the first terminal, the second terminal, the third terminal, and the fourth terminal are spaced apart from each other by a constant first interval, and the switch module comprises a planar electrode having a width in first direction greater than the constant first interval in the first direction.

7. The LED lighting device of claim 1, further comprising a third light source module configured to emit the light of the first color temperature, wherein the first light source module has a first parallel number, and the third light source module has a second parallel number different from the first parallel number.

8. The LED lighting device of claim 7, wherein the operation mode of the switch module further comprises a fourth mode of operation of emitting a light of a fourth color temperature which is different from the first color temperature, the second color temperature, and the third color temperature, and, in the fourth mode of operation, the second light source module and the third light source module are connected to each other in parallel.

9. The LED lighting device of claim 1, wherein a first parallel number of the first light source module is different from a second parallel number of the second light source module.

10. The LED lighting device of claim 9, wherein the first color temperature is higher than the second color temperature, and the first parallel number is greater than the second parallel number.

11. An LED lighting device, comprising:

a power supply configured to supply a constant current;

a first channel in which one or more first type of LEDs are disposed in series to have a first current flow direction with respect to the power supply, wherein a light of each of the first type of LEDs has a first color temperature;

a second channel in which one or more second type of LEDs are disposed in series to have a second current flow direction with respect to the power supply, wherein the first current flow direction and the second current flow direction are the same, and wherein a light of each of the second type of LEDs has a second color temperature different from the first color temperature; and a switch configured to turn on the one or more first type of LEDs and the one or more second type of LEDs in an operation mode comprising:

a first operation mode of electrically connecting the first channel to the power supply;

a second operation mode of electrically connecting the second channel to the power supply; and a third operation mode of parallel-connecting the first channel and the second channel and electrically connecting the power supply to both of the first channel and the second channel.

12. The LED lighting device of claim 11, wherein a maximum number of the first type of LEDs which are series-connected in the first channel is the same as a maximum number of the second type of LEDs which are series-connected in the second channel.

13. The LED lighting device of claim 11, further comprising:

a third channel in which one or more third type of LEDs are disposed in series, wherein a light of each of the third type of LEDs has the first color temperature; and a fourth channel in which one or more fourth type of LEDs are disposed in series, wherein a light of each of the fourth type of LEDs has the second color temperature, wherein a parallel number of each of the first channel, the second channel, the third channel, and the fourth channel is 1.

14. The LED lighting device of claim 13, wherein:

the operation mode of the switch further comprises an (n)th operation mode different from the first operation mode, the second operation mode, and the third operation mode, the first channel, the second channel, the third channel, and the fourth channel are included in a light source module, and the light source module emits lights of different color temperatures in all of the first operation mode, the second operation mode, the third operation mode, and the (n)th operation mode.

15. The LED lighting device of claim 11, wherein the switch comprises a slide switch or a rotary switch.

16. An LED lighting device, comprising:

a light source including a first light source configured to emit a light of a first color temperature and a second light source configured to emit a light of a second color temperature; and a switch configured to electrically connect a power supply to at least one of the first light source and the second light source according to an operation mode of the LED lighting device so that the light source emits one of the light of the first color temperature, the light of the second color temperature, and a light of a third color temperature, wherein the second color temperature is different from the first color temperature, and the third color temperature is between the first color temperature and the second color temperature, and wherein the light of the third color temperature is generated if the switch parallel-connects the first light source and the second light source.

17. The LED lighting device of claim 16, wherein the first light source comprises one or more first parallel lines which are parallel-connected to each other, each of the first parallel lines comprises one or more first LEDs which are series-connected to each other and a cathode of each of the first LEDs is oriented toward a common terminal connected to both the first light source and the second light source, the second light source comprises one or more second parallel lines which are parallel-connected to each other, and each of the second parallel lines comprises one or more second LEDs which are series-connected to each other and a cathode of each of the second LEDs is oriented toward the common terminal.

18. The LED lighting device of claim 17, wherein a number of the first parallel lines is different from a number of the second parallel lines.

19. The LED lighting device of claim 16, wherein the switch comprises a physical switch which is physically in contact with the first light source and the second light source.

20. The LED lighting device of claim 16, wherein the power supply connected to the switch configured to supply a constant current to the light source.

* * * * *